US006770002B2

(12) United States Patent
Aigotti

(10) Patent No.: US 6,770,002 B2
(45) Date of Patent: Aug. 3, 2004

(54) LASER BAT

(76) Inventor: Christine Aigotti, 111 S. 6th St., New Hyde Park, NY (US) 11040

( * ) Notice: Subject to any disclaimer, the term of this patent is extended or adjusted under 35 U.S.C. 154(b) by 0 days.

(21) Appl. No.: 10/116,491

(22) Filed: Apr. 4, 2002

(65) Prior Publication Data

US 2003/0190982 A1 Oct. 9, 2003

(51) Int. Cl.[7] ..... A63B 69/00; A63B 57/00

(52) U.S. Cl. ..... 473/457; 473/453; 473/409; 473/220; 362/253; 446/219; 446/485

(58) Field of Search ..... 473/220, 221, 473/223, 451, 453, 457, 564–568, FOR 102, 105, 168, 169; 434/247; 33/286, 289; 446/219, 484, 485; 362/102, 259

(56) References Cited

U.S. PATENT DOCUMENTS 2,080,608 A * 5/1937 Hannaford ..... 473/220
2,245,349 A * 6/1941 Lombardi ..... 362/577
3,117,451 A * 1/1964 De La Verne Ray et al. ..... 473/453
3,436,076 A * 4/1969 Barthol ..... 473/457
4,208,701 A * 6/1980 Schock ..... 362/202
4,343,467 A * 8/1982 Newcomb et al. ..... 473/567
4,678,450 A * 7/1987 Scolari et al. ..... 446/405
4,693,479 A * 9/1987 McGwire ..... 473/220
5,154,427 A * 10/1992 Harlan et al. ..... 473/218
5,186,458 A * 2/1993 Redondo ..... 473/570
5,269,528 A * 12/1993 McCardle, Jr. ..... 473/409
5,692,965 A * 12/1997 Nighan et al. ..... 473/220
5,775,800 A * 7/1998 Hsieh ..... 362/295
5,788,582 A * 8/1998 Shapiro ..... 473/220
5,954,598 A * 9/1999 Carlson ..... 473/458
5,993,333 A * 11/1999 Heckaman ..... 473/409
6,254,493 B1 * 7/2001 Wurster ..... 473/220

FOREIGN PATENT DOCUMENTS

WO WO 9324183 A1 * 12/1993 ..... A62B/69/40

* cited by examiner

*Primary Examiner*—Stephen P. Garbe
*Assistant Examiner*—Mitra Aryanpour
(74) *Attorney, Agent, or Firm*—Jaspan Schlesinger Hoffman

(57) ABSTRACT

A bat, constructed generally of the shape, weight and material usually used and formed for the batter is provided so as to have a small diameter stream of light extended through the central axis from one end to the other. The formation of the light stream emitting out the knob end of the bat will allow the batter to correctly align the knob of the bat with the ball during the initial movement of a swing. The batter and his/her coach will then be able to determine if there are errors in the player's angular position of the bat relative to the ball.

7 Claims, 2 Drawing Sheets

LASER BAT

RELATED DISCLOSURE

The present application contains subject matter disclosed in Disclosure Document No. 494,700 recorded on Jun. 14, 2001. The subject matter is incorporated herein as if more fully set forth.

BACKGROUND

The present invention relates to a training device for hitting a ball and in particular, to a device for improving the hitting of a baseball and softball and its method of use.

Baseball is the prime example of hitting a ball with a bat. It is also known as the national pastime of the United Sates and other countries such as Cuba and Venezuela. To the random player or observer, it seems elusively easy to play. It employs nine positioned men who bat in sequence; a batter whose function is to hit the ball; an approximate 2½ inch ball or 3–6 inch softball is thrown to the batter with an art preventing the batter from successfully hitting the ball. While a certain degree of innate skill is required for each of the players at their respective positions, the great attribute to fine playing is a learned skill, namely how best to hit the baseball or softball. As the ball must travel more or less accurately within the bounds of the playing field while avoiding being caught, this skill is most difficult.

It has been found that great accuracy and power results when the bat strikes the ball at the thickest part of the bat, commonly called the "sweet spot" and along the longitudinal axis of the bat. Should the bat knob be improperly aligned or should the bat axis be angled or inclined away from the optimum position, the ball slices, curves and takes an errant trajectory in its course. During play, no extraneous device, helper or aid may be used and all skills must be learned before the player gets on the field. Thus, the skills the player must use to hit a safe ball must be learned and must become second nature to him in order for him to be a good player.

It is, therefore, an object of the present invention to provide a training device enabling a baseball/softball player to become more proficient in hitting.

It is a further object of the present invention to provide a hitting device which is as close in construction and use as the bat employed by the hitter during actual play and which employs the basic technique of hitting, so that the technique becomes second nature to the hitter rather than merely a temporary aid in hitting.

Further, objects and advantages are set forth in the following disclosure.

SUMMARY OF THE PRESENT INVENTION

In the present invention, a bat, constructed generally of the shape, weight and material usually used and formed for the batter is employed. In addition to the features common with those used by the batter, the inventive bat is provided so as to have a small diameter stream of light extend through the central axis from one end to the other. The formation of the light stream emitting out the knob end of the bat will allow the batter to correctly align the knob of the bat with the ball during the initial movement of a swing. The batter and his/her coach will then be able to determine if there are errors in the player's angular position of the bat relative to the ball.

Preferably, the stream of light is provided through the use of a fiber optic lens such as a fiber glass thread, powered by a small switch operated by a battery housed within the bat.

In addition to the axial directed light, the bat may include one or more streams of subsidiary lights each extending in a curved direction from the axial directed to a point on the peripheral surface of the bat are paired and spaced axially along the "sweet spot", thereby allowing the batter to optimally correct the bat's "sweet spot" with the ball.

Full details of the present invention are set forth in the following description and in the attached drawings.

DESCRIPTION OF THE INVENTION

Figure 1:
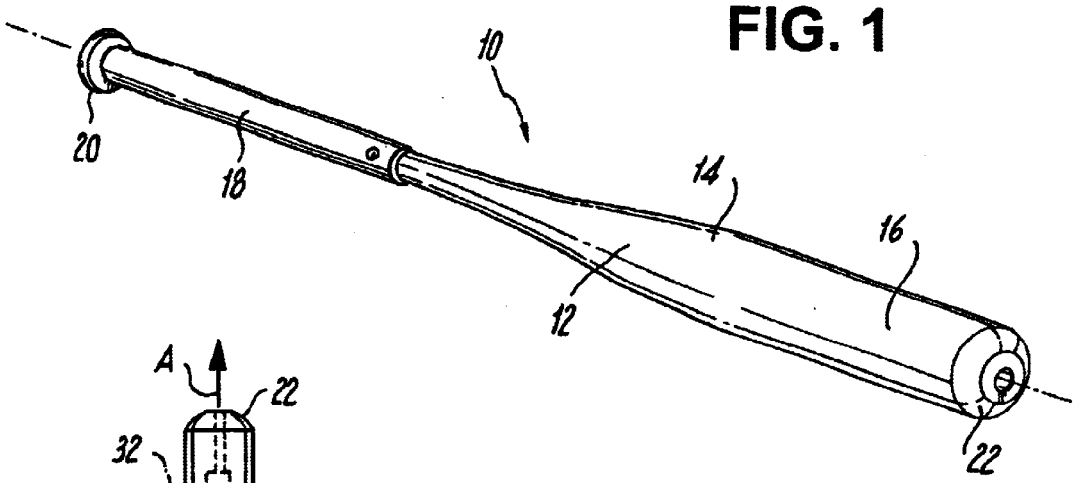
FIG. 1 is a perspective view of the bat according to the present invention.

Turning first to FIG. 1 is seen that the bat 10 comprises a body 12, shaped so as to provide a curved outer surface 14 on which the ball is struck. The body 12 is shaped so as to provide an optimal position 16, euphemistically called the "sweet spot", where the bat and ball produce the greatest transfer of force. The lower end of the bat 10 is shaped as a handle 18, allowing the user to comfortably hold the bat and terminates in this end with a knob 20 preventing undesirable slippage of the bat during the user's swing. The opposite end 22 (adjacent to the "sweet spot") is generally called the head.

The body 12 and the handle 18 are separate elements removably joined for use. The head end is formed with an internally threaded fitting 24 at its lower end and the handle is formed at its forward end with an externally threaded fitting 26. The fittings 24 and 26 cooperatively screw the bat together to form one piece. Extending from one end to the other, the bat 10 is formed with a bore 29 substantially along its center longitudinal axis.

Figure 2:
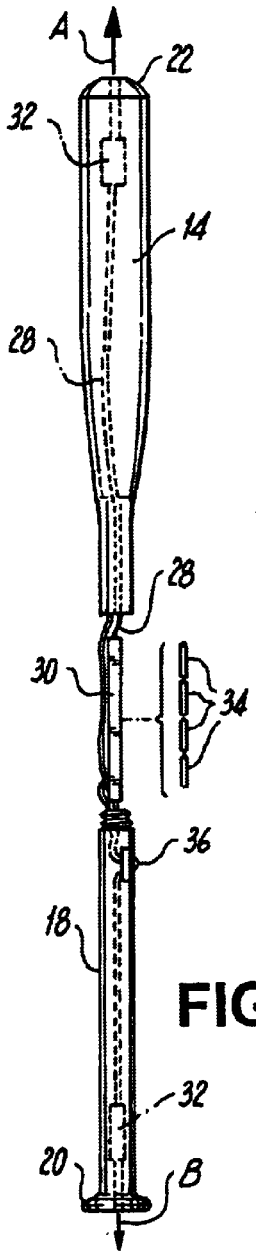
FIG. 2 is a vertical plan view of the bat of FIG. 1 partially broken away showing the application of the present invention to the interior of the bat.

In the embodiment of FIG. 2, the bore 28 houses a thin electrical wire 30 terminating at each end, in a socket 32 in which a small bulb is placed. At the position where the head and handle are joined together, the wire 30 is conventionally connected to a series of small batteries 34, LED or other source of energy. Suitable supports for fitting the batteries within the bat 10 is a bracket 36. The arrangement of batteries and lights is completed by a small switch 38 operable from the bat handle exterior surface. Since the bore 29 terminates at each end at the axial center, activation of the bulbs within each socket 32 propels light outwardly of each end, in the direction of arrow A and B as seen in FIG. 2. The bulb may be covered by suitable lens means, as at 40, to increase the illumination.

Figure 3:
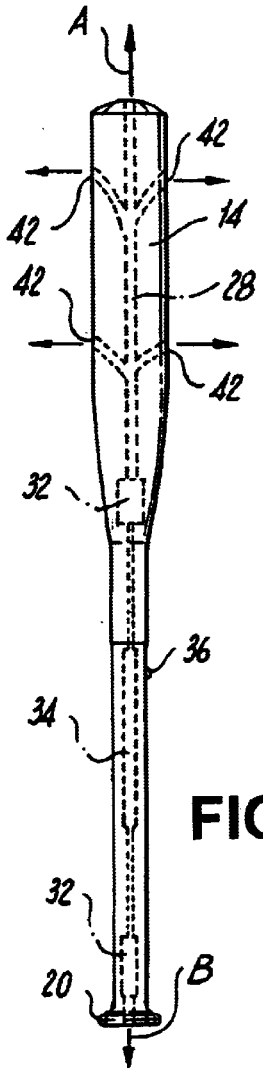
FIG. 3 is a view of a bat exhibiting another method of assembling the light.
Figure 4:
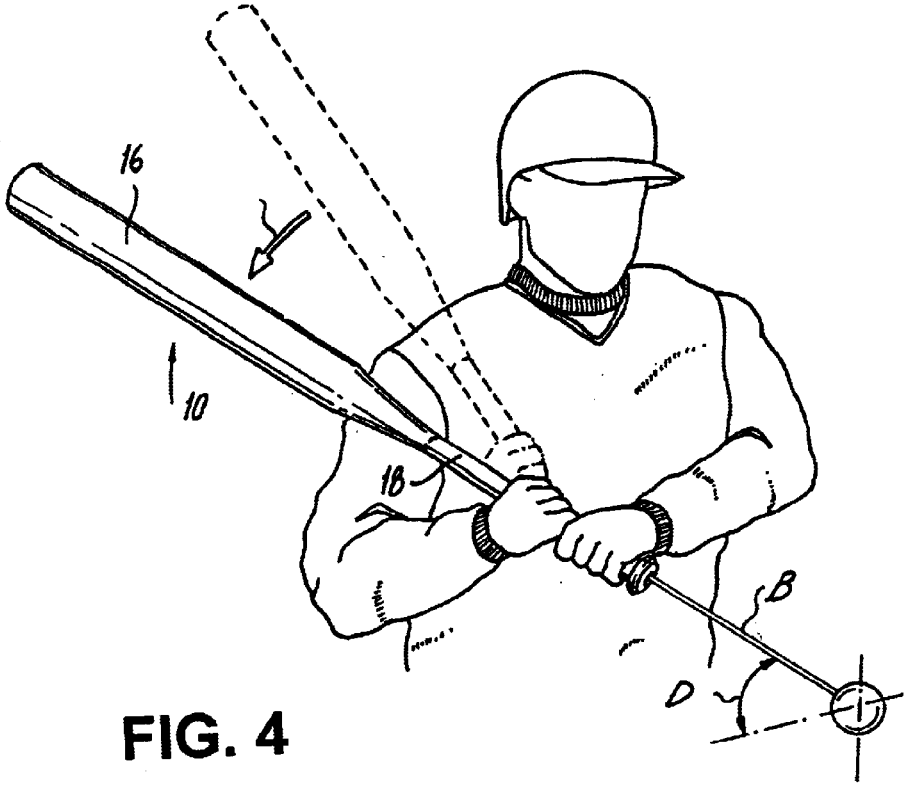
FIG. 4 is a view of a user of the inventive bat, showing the direction in which the ball is picked up by the axial light.

In the embodiment of FIG. 3, basically the same construction is employed, in forming the bat to join the head and handle, housing and operating the electrical system. Here, however, the central bore is provided with a light transmitting or optic cable 28 such as fiber glass thread, laser cable, glass or non threaded cable. The light source such as the socket and bulb 32 and 34 can be repositioned as desired particularly the one in the head end. The emanating light will continue to be along the axial center following arrows A and B. In this matter, the hitter will train his bat so that the initial portion of the swing is as seen in FIG. 4, where the arrow from the lower end is pointed directly at the ball.

In addition to the central bore 29, one or more auxiliary bores 42 may be provided, each extending from the central bore along a singular path to the peripheral surface of the head terminating in a light window, perpendicular to the central axis. Preferably at least four of the auxiliary bores (two pairs) are provided so that at least one pair extends about a ¼ of the circumference of the bat. The auxiliary bores may also be provided with the light transmitting optical cable such as glass thread or laser wire. Each pair of auxiliary bore 42 is spaced from its adjacent pair a distance equal to the "sweet spot" of the bat.

In use, the inventive bat is of great and simple help to the batter as well as to his/her trainer. For example, FIG. 4 illustrates the proper position of the batter during the initial phase of the swing. Here the axis B of the bat must be aimed from the handle end, directly on to the ball. Normally, a hitter when waiting for the pitcher to throw the ball rests his bat on or near his shoulder. This places the bat in the wrong position and he must quickly take the bat from his shoulder, move it through the angle D and align it with the ball as shown. The axial light B helps teach the batter that he must remove the bat from his shoulder and align the bat and ball to start the swing.

Figure 5:
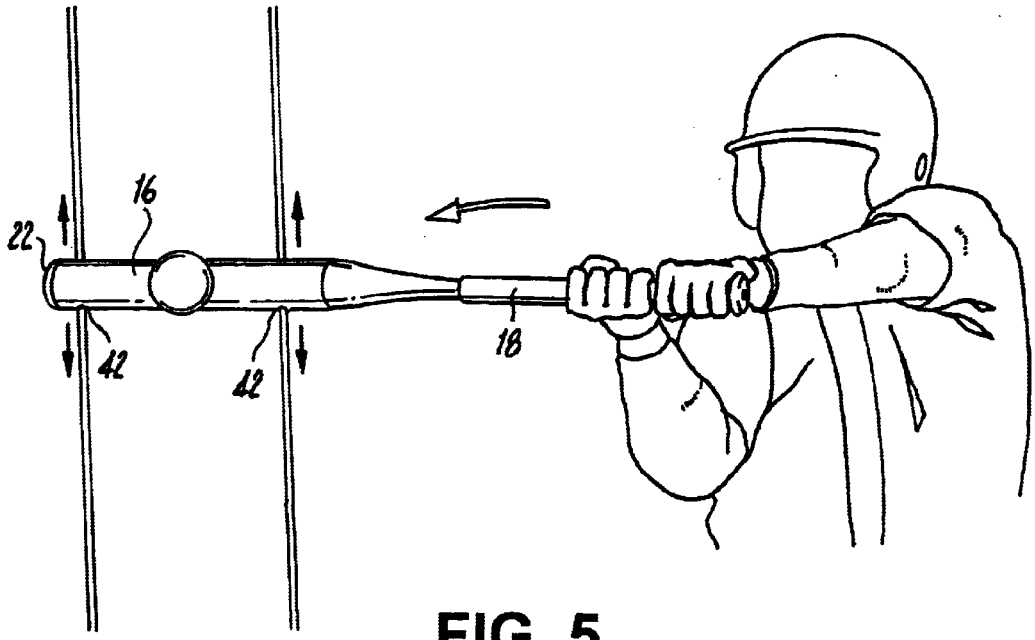
FIG. 5 is the view of the user striking the ball at the "sweet spot".

In order to hit the ball, the batter must then swing so that the bat is in a horizontally parallel position to the plane of the ground, so that the ball is in the position to fully meet the "sweet spot" 16. Since the "sweet spot" is defined by the spacing between the peripheral lights, this can easily be visualized by the batter and the trainer as seen in FIG. 5.

The inventive bat is very useful for the training of hitters of all ages using a bat and ball. The bat not only resembles a conventional bat but feels in shape and weight exactly like that used by the player. The training of baseball and softball athletes as well as small children of all ages and professional players can be helped without modification of the ball, bat and pitching. Reinforcement of the optimal hitting mechanisms can be made within a known training process.

Various modifications and changes have been seen in the foregoing description. Others will be obvious to those in the art. Accordingly, the present invention is not limited to the disclosure alone but to the claims attached hereto.

What is claimed is:

1. A training device for baseball hitters comprising a bat having a head and a handle, a source of light arranged within said bat to emit at least from said handle a beam of light along an axis central to the longitudinal axis of said bat, the bat having means with said bore to transport said light from said source of light to the ends of said bore, at least one pair of spaced openings extending from said bore transverse of the central axis and extending to the peripheral surface of said bat to define the "sweet spot" of said bat body.

2. The training device according to claim 1, wherein said source of light emits a beam of light from said head simultaneously with the beam from said handle.

3. The training device according to claim 1, wherein said bat is formed with an elongated bore from end to end and houses within said bore the source of said light beam.

4. The training device according to claim 3, wherein said source of light comprises at least a battery and a light bulb located on the interior of said bat connected there between a switch positioned exterior to the bat and connected with at least the battery and light.

5. The training device according to claim 4 and lens means extending from said bulb to the end of said bore to emit said light.

6. The training device according to claim 1, having transport means for the light source within said bore to transport said light from said source of light to the ends of said bore.

7. The training device according to claim 6, wherein said transport means comprise optic cable fiberglass thread, glass threads or laser wire.

* * * * *